US005687873A

United States Patent [19]

Jones

[11] Patent Number: 5,687,873

[45] Date of Patent: Nov. 18, 1997

[54] BRUSH REST

[76] Inventor: Kevin William Jones, 3 Bluegate Barn, Bluegate Lane, Old London Road, Capel St Mary, Ipswich IP9 2JX, United Kingdom

[21] Appl. No.: 656,918

[22] Filed: Jun. 3, 1996

[30] Foreign Application Priority Data

Jun. 16, 1995 [GB] United Kingdom ..... 9512256

[51] Int. Cl.[6] ..... B65D 25/20

[52] U.S. Cl. ..... 220/736

[58] Field of Search ..... 220/736, 570, 220/482, 480

[56] References Cited

U.S. PATENT DOCUMENTS

| | | | |
|---|---|---|---|
| 3,625,388 | 12/1971 | Golden | 220/570 |
| 3,688,943 | 9/1972 | Brown | 220/90 |
| 3,707,242 | 12/1972 | Golden et al. | 220/570 |
| 4,561,556 | 12/1985 | Bendix | 220/90 |
| 4,927,046 | 5/1990 | Armstrong | 220/736 |
| 5,052,581 | 10/1991 | Christ et al. | 220/570 |
| 5,097,975 | 3/1992 | Waterston et al. | 220/482 |
| 5,261,577 | 11/1993 | Goldstein et al. | 220/736 |

FOREIGN PATENT DOCUMENTS

| | | | |
|---|---|---|---|
| 2188026 | 9/1987 | United Kingdom | B65D 25/20 |
| 2231550 | 11/1990 | United Kingdom | B65D 25/20 |
| WO 93/02871 | 2/1993 | WIPO | B44D 3/12 |

*Primary Examiner*—Stephen J. Castellano
*Attorney, Agent, or Firm*—Charles D. Gunter, Jr.

[57] ABSTRACT

A brush rest for a paint brush comprises a container 1 with an opening for inserting the paint brush. The container 1 may be secured to a paint pot 36 by a resilient member 24 which functions to grip the paint pot between the resilient member 24 and the container 1, so that the brush may be rested in the container 1 when the painter takes a break from painting. The resilient member 24 may be provided with finger grips 28 which project above the container 1 to allow attachment or removal without touching paint in the paint pot.

2 Claims, 6 Drawing Sheets

BRUSH REST

The present invention relates to a brush rest, and particularly to a rest for a paint brush for use when taking a break from painting.

BACKGROUND TO THE INVENTION

When painting a wall, room, or other object with a paint brush, it is a problem to find a suitable temporary receptacle for resting or storing the brush when taking a break for any reason. The brush will often sink too far if left in the pot of paint, and the area being painted may be remote from any other brush rest.

It has been proposed, in United Kingdom patent number 2 231 550, to provide a brush rest comprising an open topped container for receiving a paint brush, the container being provided with a pair of spaced apart resilient hook members arranged for attachment of the holder to paint containers of various shapes and dimensions.

This brush holder allows a brush to be rested upright in the container when a painter takes a break from painting. However, the brush head will be in contact with any paint or thinner which lies in the bottom of the container, and this may not be desired by the painter.

It is an object of one aspect of the present invention to reduce the above mentioned problem.

To remove the known brush rest from a paint pot it is necessary to use both hands; one hand to hold the pot in place, and the other to prise the resilient hook members from off the rim of the paint pot. If the paint pot is relatively full, removal of the brush rest from the pot may entail the painter having to dip his fingers in the paint to effect removal of the brush rest.

It is another object of the present invention to provide a brush rest which may be removed from a paint pot with a one-handed operation, and without the painter's fingers coming into contact with paint in the pot.

SUMMARY OF THE INVENTION

Accordingly, a first aspect of the present invention provides a brush rest for a paint brush, said brush rest comprising a container which is provided with means for securing the container to a paint pot, said container having a floor and said floor having walls defining a well in which a thinner or other liquid may be stored, said container having at least one opening so that when the container is secured to a paint pot it has an open top and a side opening through which a brush may be rested in the container, whereby a brush may be rested on the floor of the container without entering the well.

By securing the container to the paint pot, a painter can ensure that the brush rest for the paint brush is available during painting so that the brush may be temporarily stored in the container. The brush may be rested temporarily on the floor of the container, without coming into contact with thinner or paint in the well. If it is preferred to rest the brush in the well, this may of course be done, either by pushing the brush in further through the side opening, or by resting the brush in a more vertical incline through the top opening.

The container may be secured to the paint pot by any suitable securing means. The securing means may for example comprise a pair of hooks hook which are shaped to allow the container to be hung over the rim of the opened paint pot. Other securing means may also be used, for example a bracket which may be clamped, tied, or otherwise secured around the paint pot, or which is resilient and a snap fit for the tin. Securing the brush rest around the side of the tin allows the lid to be put back on the tin without removing the brush rest.

It is particularly preferred to provide the container with securing means which allow the container to be removed from a paint pot by a one handed operation, and which a painter can remove without having to dip his fingers in the paint in the pot. Accordingly, the securing means preferably comprises a resilient member held in a spaced apart relationship with the container, the resilient member having a first end and a second end which are adapted to be deployed away from the container in response to applied force to create an insertion gap into which a wall of a paint pot may be inserted along a generally vertical line of insertion, the resilient member being disposed transversely to the line of insertion and adapted to grip a wall of a paint pot between the resilient member and the container when the applied force is released.

The resilient member may readily be attached to, or detached from, a paint pot by using one hand to deploy the ends of the resilient member away from the container, and to place the brush rest over a wall of the paint pot. The resilient member may optionally be provided with one or more lugs or finger grips to facilitate deployment of the ends of the resilient member away from the container. These lugs may be disposed above the container when in use, so that the resilient member may readily be operated without the painter's hand coming into contact with paint in the paint pot.

When the brush rest is mounted on a paint pot, the resilient member may bear directly on an inner wall of the paint pot. Alternatively the resilient member may be provided with one or more bracing members, for example, fingers which extend towards the container, which bracing members bear against a wall of the paint pot.

Because the resilient member may be deformed or flexed to different radii, the container may readily be secured to different sizes of paint pots or to paint pots of different diameters.

The term "paint pot" is used herein to refer to a tin, can, tub, bucket or similar paint container.

The container may comprise a shallow tray in which the brush is rested, or it may comprise a relatively high sided open top structure in which the brush may be rested in a generally vertical orientation.

The side opening of the container allows the brush to be inserted from the side and to rest at an angle on the floor of the container. The open top of the container allows the brush to be laid in the container from above and to allow access to the container for cleaning it.

It is preferred that the container has a floor which slopes downwardly away from the side opening so that paint from the brush runs away from the side opening.

The side opening is preferably defined by a pair of side walls and an end wall upstanding from the floor of the container.

Preferably the height of the end wall is such that a brush may be supported between the top of the wall and the floor of the container at an angle to the horizontal in the range 3° to 45°. It is particularly preferred that the height of the end wall is such that a brush may be supported between the top of the wall and the floor of the container at an angle to the horizontal in the range 5° to 15°.

The floor of the container is provided with a well in which the brush may be stored in a generally vertical orientation.

This allows the brush to be stored for longer periods, for example overnight, by filling the well with thinner, water, or any other appropriate solvent or carrier medium for the paint, so that the bristles of the brush do not dry out.

The well may be located at any convenient position in the floor of the container, but it is preferably located at the end of the container remote from the side opening.

The side opening preferably does not extend to the floor of the container, but is defined at its lower edge by a wall or rim on which the brush may rest when laid on its side in the container. The brush may be wiped on the top of the wall, to remove excess of paint, and the wall may be provided with a lip to help retain in the container paint which has been wiped from the brush.

The lip may be any suitable shape or configuration, but preferably has a top edge which is bent or curved inwardly to the container so as to help retain paint in the container.

The brush rest may be made from any suitable material. It is preferred that the brush rest is made from a solvent-resistant plastics material. Suitable materials include polypropylene and Nylon. Polypropylene is particularly preferred.

By forming the container and securing means from a plastics material, manufacturing costs may be reduced. If the securing means comprise one or more hooks, the resilience of the plastics material allows the hooks to be formed as a snap fit for the rim of the paint pot, which will resist accidental removal of the brush rest from the paint pot.

Where the container is manufactured from a plastics material, it is preferred that the resilient member is formed from the same plastics material so that the brush rest is of unitary construction, for example by injection moulding. However it would also be possible to construct the resilient member from other materials, for example spring metal, or of a metallic or plastics material and spring means.

The brush rest may optionally be provided with a lid so that the container may be wholly or partially sealed to prevent or reduce the escape of paint or other fumes from the container. This may help to prevent drying out of paint in the container and to reduce the level of paint fumes in the atmosphere.

DESCRIPTION OF THE PREFERRED EMBODIMENT

The invention will now be further described, by way of example, with reference to the following drawing in which.

Figure 1:
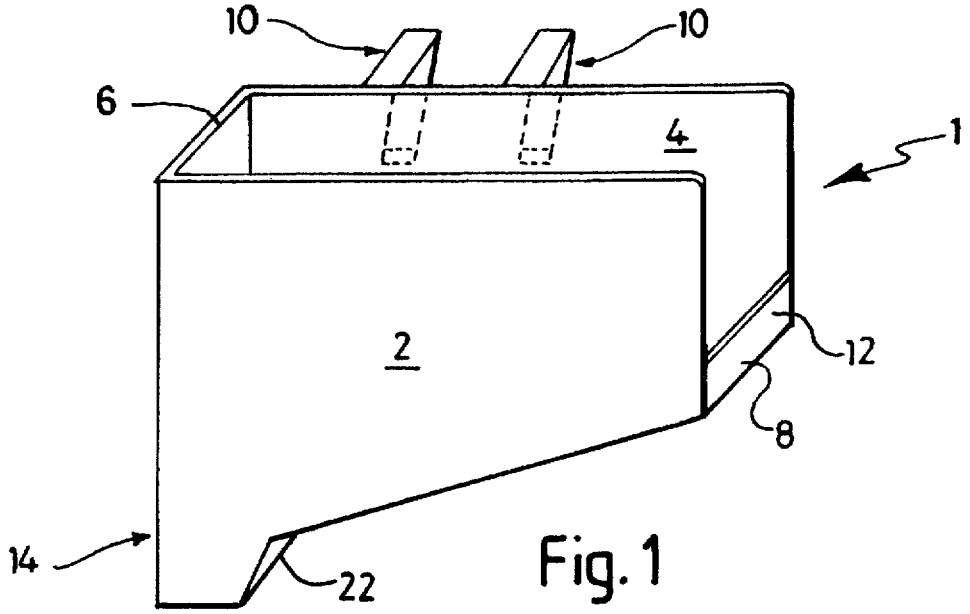
FIG. 1 is an isometric view of a brush rest in accordance with the present invention.
Figure 2:
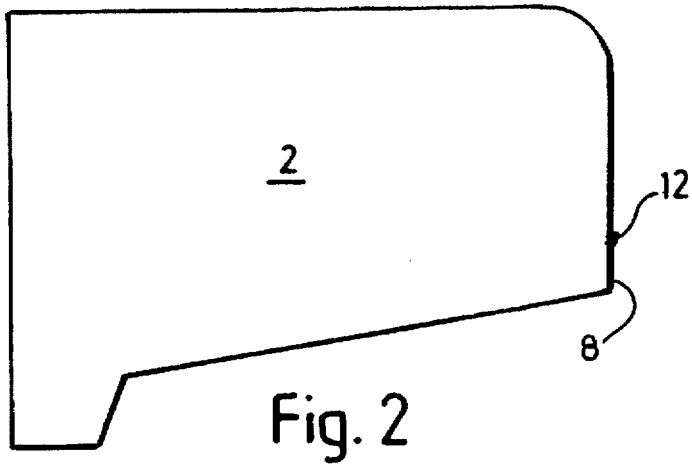
FIG. 2 is a side elevation view of the brush rest shown in FIG. 1.
Figure 4:
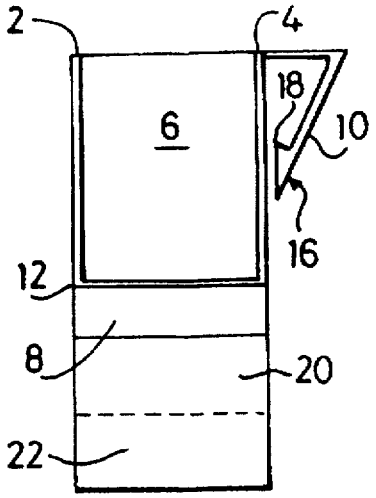
FIG. 4 is an end elevational view of the brush rest shown in FIG. 1.
Figure 3:
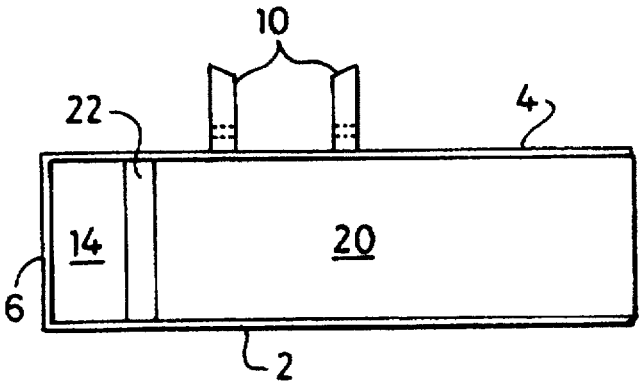
FIG. 3 is a plan view of the brush rest shown in FIG. 1.
Figure 5:
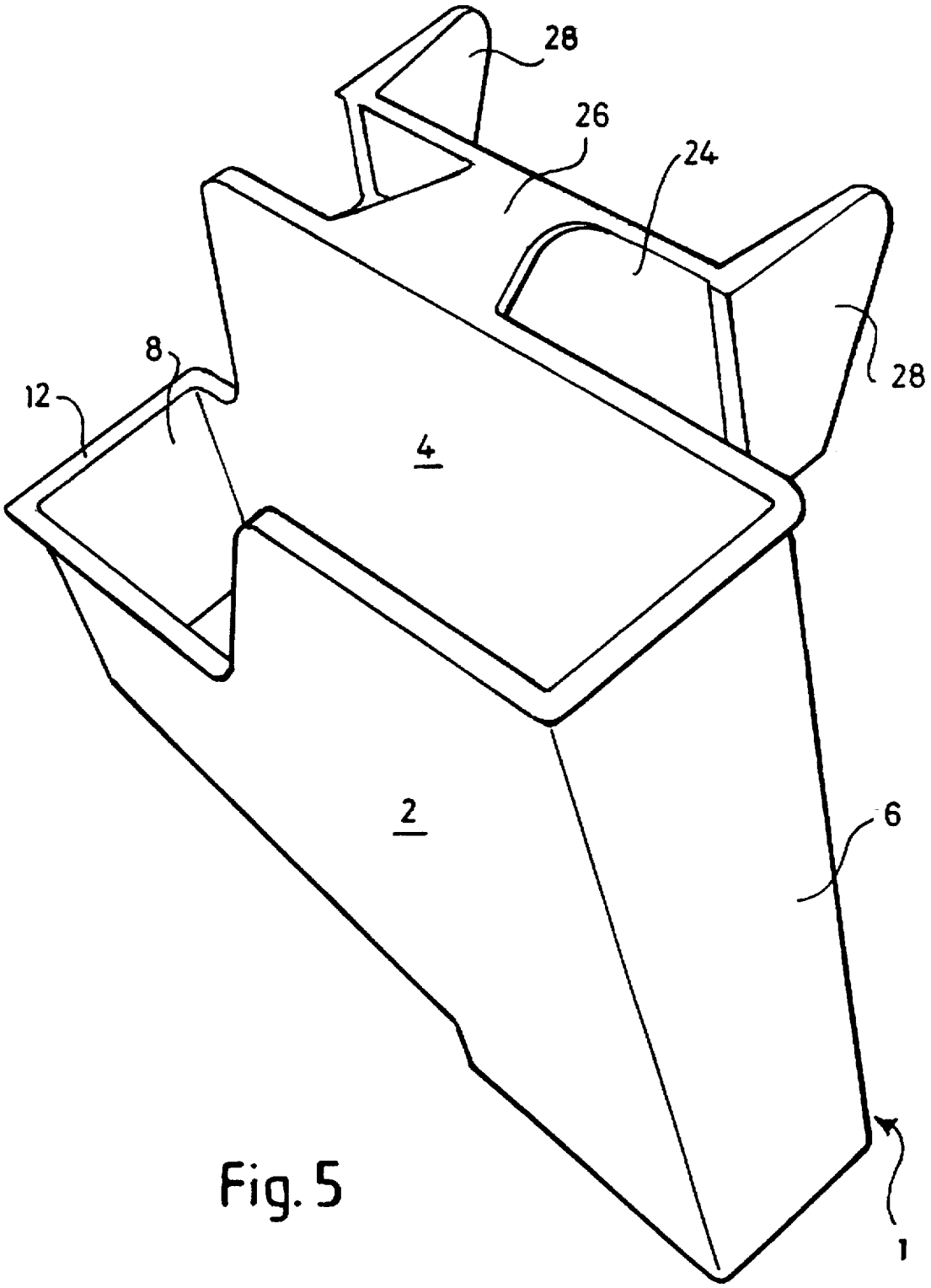
FIG. 5 is a perspective view from above and to one side of a brush rest in accordance with a preferred embodiment of the invention.
Figure 6:
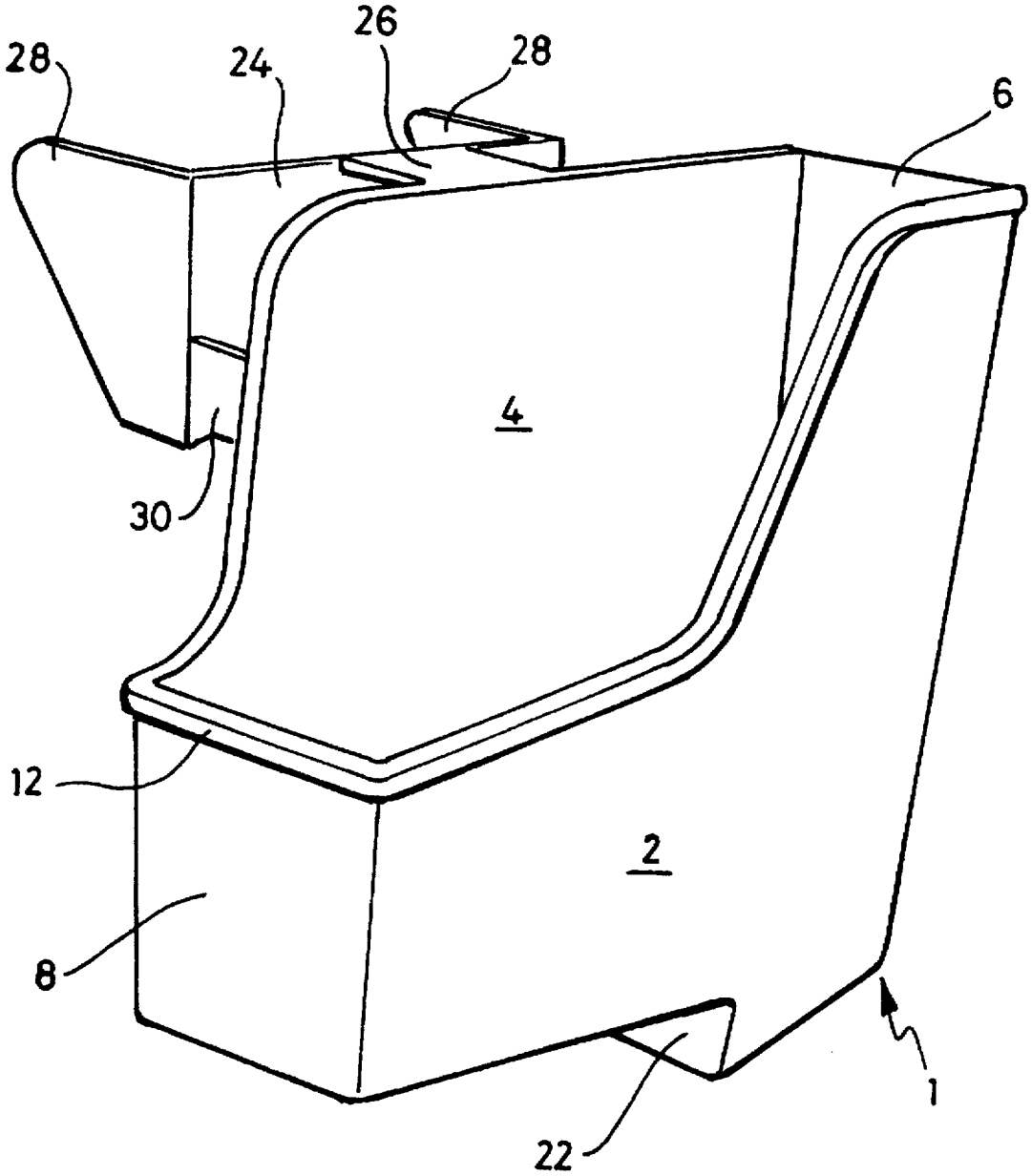
FIG. 6 is a perspective view of the brush rest shown in FIG. 5 from in front and to one side.

The paint brush rest comprises a container 1 and a pair of hooks 10 for securing the container 1 to a paint tin. The container 1 and hooks 10 are formed from polypropylene by injection moulding, blow moulding, or any other suitable technique. In use the hooks 10 are resilient and can be snap fitted over the rim of the paint tin.

The tip 16 of the hook 10 is provided with a barb 18 which engages with the inside of the rim of the paint tin and helps to prevent accidental removal of the brush rest from the paint tin.

The container 1 has a floor 20, a pair of side walls 2 and 4, a first end wall 6 and a second end wall 8. The top of the container is open to allow a paint brush to be rested in the container, and the second end wall 8 is quite low. Examples of dimensions are 140 mm height for the first end wall 6; 140 mm length for the side walls 2 and 4, and 13 nun for the second end wall. Other dimensions art of course possible, for different sizes of brush and/or paint tin, and these dimensions do not limit the invention in any way.

The floor 20 slopes downwardly from the wall 8 at a constant angle, and falls away steeply at 22 to define with the side walls 2 and 4, and the end wall 6, a well 14 in which a brush may be rested with the longitudinal axis of its handle in a generally vertical orientation. The well 14 may be filled with thinner or other appropriate solvent or carrier medium for cleaning the brush or keeping its bristles wet.

When a painter takes a break from painting, the brush is laid on the floor 20 of the container 1, with the handle resting on top of the end wall 8. The floor 20 of the container 1 is liquid-tight, and paint from the brush is therefore kept in the container. The wall 8 is provided with an inwardly directed lip 12 on which the brush may be wiped to remove excess of paint or thinner if desired.

FIGS. 5 to 9 show a preferred embodiment of the invention, in which the container 1 is provided with a resilient member 24 for use in securing the brush rest to a paint pot 36. The resilient member 24 is connected to the container 1 by a connecting member 26, and is provided with a pair of lugs or finger grips 28, one at each end. The resilient member 24 is also provided with a pair of bracing members 30 which are generally disposed towards the container 1. The container 1, the resilient member 24, the connecting member 26, and the lugs 28 are of unitary construction formed from polypropylene or similar plastics material.

Figure 7:
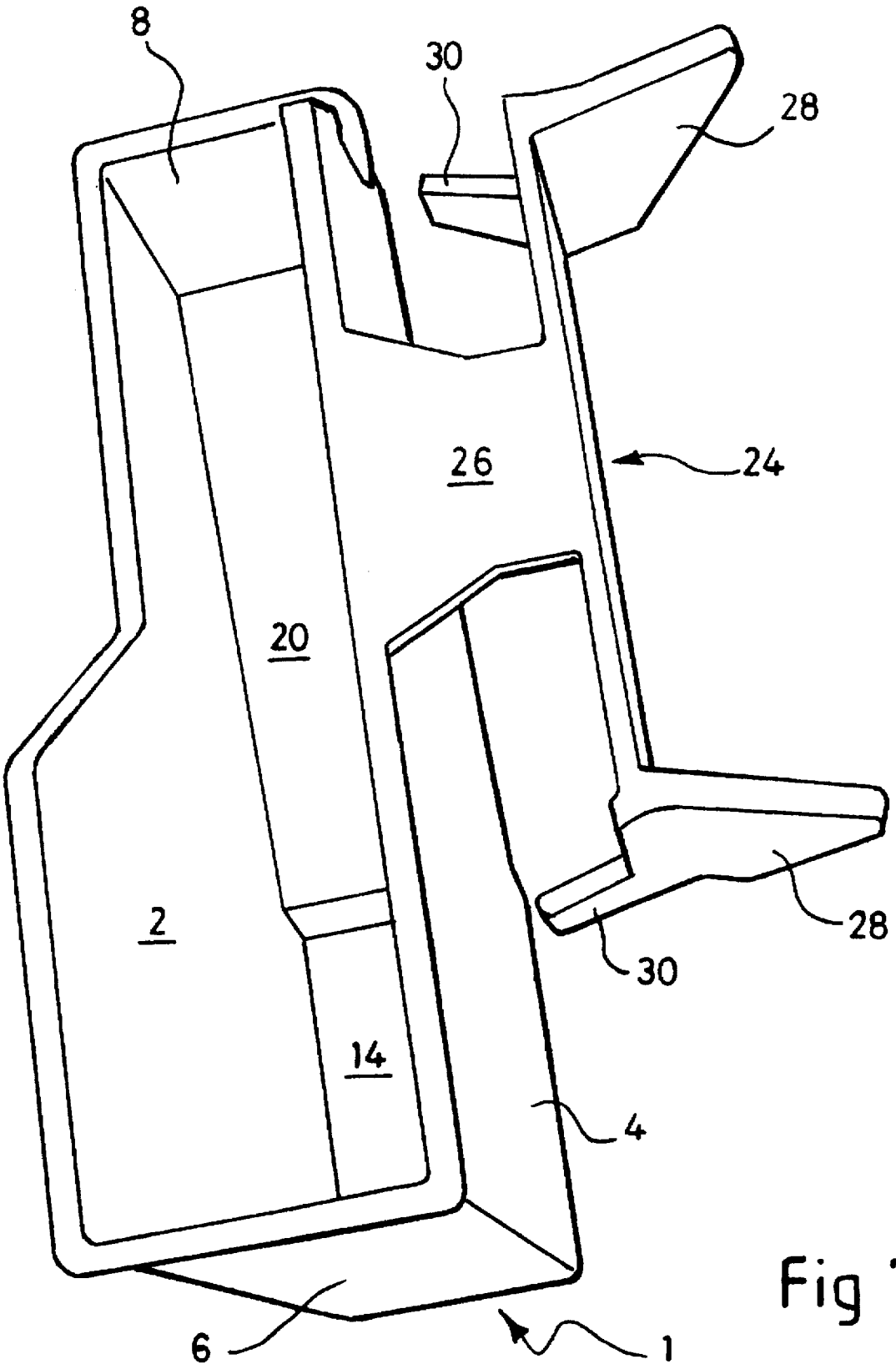
FIG. 7 is a perspective view of the brush rest shown in FIG. 5 from above and to the other side.
Figure 8:
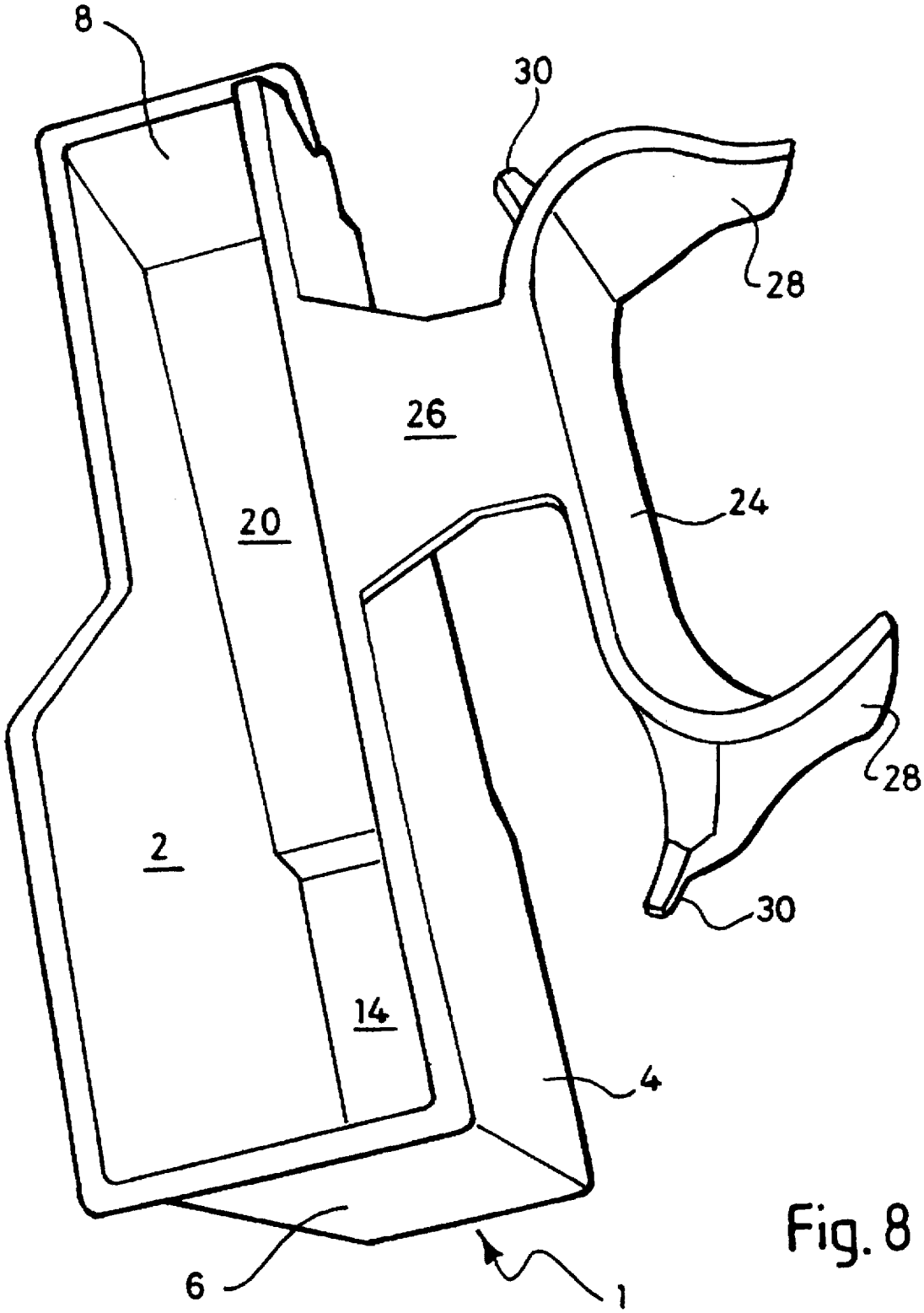
FIG. 8 is a perspective view similar to that shown in FIG. 7, in which the resilient member is deployed away from the container.
Figure 9:
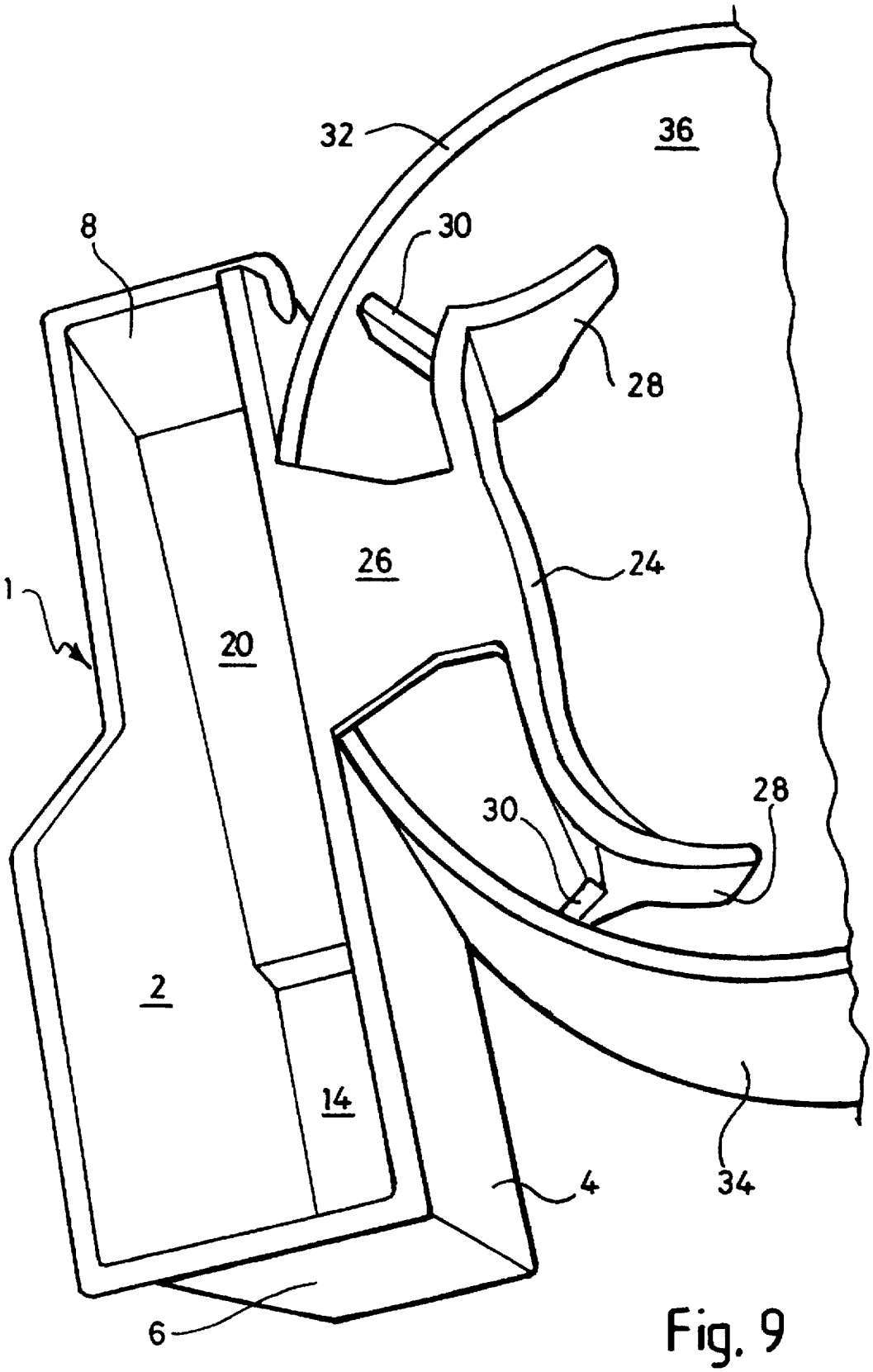
FIG. 9 is a perspective view similar to those shown in FIGS. 7 and 8, in which the brush rest in mounted on a paint pot.

In an unstressed state, as best shown in FIG. 7, there is a gap between the resilient member 24 and the container 1. However this gap is not large enough to accommodate the wall 34 of a paint pot 36. To mount the brush rest on the paint pot 36 the lugs 28 are gripped and squeezed together, as shown in FIG. 8. This causes the ends of the resilient member 24, and the bracing members 30, to be deployed away from the container 1 and open up an insertion gap into which the wall 34 of a paint pot 36 may be inserted along a generally vertical line of insertion.

When the rim 32 of the paint pot 36 has been fully or partially inserted into the insertion gap, the painter releases the lugs 28, and the resilient member 24 attempts to revert to its unstressed configuration as shown in FIG. 7. This causes the bracing members 30 to bear against the inner wall of the paint pot 36 and to grip the paint pot 36 between the resilient member 24 and the container 1.

The brush rest is removed from the paint pot 36 by reversing the above operation.

The lugs 28 project above the walls 2, 4, 6 of the container 1, and a painter may flex the resilient member 24 by means of the lugs 28 without bringing his fingers into contact with paint in the paint pot 36.

The invention therefore provides a convenient brush rest for resting a paint brush, which is carried with the paint pot.

Although the invention has been illustrated with reference to painting it is to be understood that the invention may equally well be used in other applications involving a brush. For example the application of a varnish, lacquer, sealant or the like. Various changes may be made to the illustrated embodiments without departing from the spirit and scope of the invention.

What I claim is:

1. A brush rest for a paint brush, said brush rest comprising a container which is provided with means for securing the container to a paint pot, said container having a floor and said floor having walls defining a well in which a thinner or other liquid may be stored, said container having at least one opening so that when the container is secured to a paint pot it has an open top and a side opening through which a brush may be rested in the container, whereby a paint brush may be rested on the floor of the container without entering the well;

wherein the means for securing the container to a paint pot comprises a resilient member held in a spaced apart relationship with the said container, the said resilient member having a first end and a second end which are adapted to be deployed away from the said container in response to applied force to create an insertion gap into which a wall of a paint pot may be inserted along a generally vertical line of insertion, the said resilient member being disposed transversely to the line of insertion and adapted to grip a wall of a paint pot between the resilient member and the container when the applied force is released; and wherein a finger grip is provided at each end of the resilient member.

2. The brush rest of claim 1 wherein when the brush rest is secured to a paint pot the finger grips project above the paint pot.

* * * * *